United States Patent [19]

Chretien

[11] Patent Number: 5,053,067

[45] Date of Patent: Oct. 1, 1991

[54] PROCESS AND APPARATUS FOR THE RECOVERY OF THE HEAVIEST HYDROCARBONS FROM A GASEOUS MIXTURE

[75] Inventor: Denis Chretien, Saint Mande, France

[73] Assignee: L'Air Liquide, Societe Anonyme pour l'Etude et l'Exploitation des Procedes Georges Claude, Paris, France

[21] Appl. No.: 489,944

[22] Filed: Mar. 9, 1990

[30] Foreign Application Priority Data

Mar. 9, 1989 [FR] France ..... 89 03073

[51] Int. Cl.[5] ..... F25J 3/02

[52] U.S. Cl. ..... 62/24; 55/16; 55/158; 62/40

[58] Field of Search ..... 62/24, 27, 28, 40; 55/16, 158

[56] References Cited

U.S. PATENT DOCUMENTS

| | | | |
|---|---|---|---|
| 3,250,080 | 5/1966 | Garwin | 62/24 |
| 4,284,423 | 8/1981 | Eakman et al. | 62/28 |
| 4,374,657 | 2/1983 | Schendel et al. | 62/28 |
| 4,411,677 | 10/1983 | Pervier et al. | 62/40 |
| 4,595,404 | 6/1986 | Ozero et al. | 62/24 |
| 4,602,477 | 7/1986 | Lucadamo | 62/24 |
| 4,681,612 | 7/1987 | O'Brien et al. | 62/40 |
| 4,732,583 | 3/1988 | DeLong et al. | 62/24 |

*Primary Examiner*—Ronald C. Capossela
*Attorney, Agent, or Firm*—Browdy and Neimark

[57] ABSTRACT

Part of the hydrogen from the gas treated, which is for example a residual gas from petroleum refinery, is first removed. The remaining mixture is introduced at an intermediate level of a distillation column which includes a head condenser operating at a temperature TF of the order of −40° C. or more. The hydrogen content of said remaining mixture is selected so that the dew point of the residual gas which is removed at the top of the column is slightly higher than the temperature TF. The heavy hydrocarbons are collected at the base of the column.

10 Claims, 2 Drawing Sheets

PROCESS AND APPARATUS FOR THE RECOVERY OF THE HEAVIEST HYDROCARBONS FROM A GASEOUS MIXTURE

BACKGROUND OF INVENTION (1) Field of the Invention

The present invention relates to the technique of recovery of the heaviest hydrocarbons from a gaseous mixture. More particularly, the present invention concerns a process for the recovery of the heaviest hydrocarbons from a gaseous mixture containing in addition, lighter components such as hydrogen, for example for the recovery of GPL ($C_3^{30}$) from a residual gas of petroleum refinery.

(2) Description of Prior Art

In the known processes for the recovery of GPL, the hydrogen is just about completely removed by a partial condensation of the mixture up to about −80° C.

This technique has many disadvantages:

the obtention of a low temperature of −80° C. leads to the utilisation of a costly two stage refrigerating unit;

the yield of recovery of the GPL is limited as a function of the low temperature selected, for example 97 or 98% for −80° C.;

the heat exchange line constitutes a costly investment;

the benzene compounds and water, even when present at very low concentration, may crystallize in the heat exchange line, leading to pluggings; it is therefore necessary to previously remove these components.

The invention is intended to provide a process which is clearly more economical and which overcomes all these disadvantages.

SUMMARY OF INVENTION

For this purpose, the process according to the invention is characterized in that:

part of the hydrogen mixture is removed;

the remaining mixture is introduced at an intermediate level of a distillation column including a head condenser which ensures a reflux in the column, this condenser being cooled by means of a cooling device capable of giving a cold temperature TF of the order of −40° C. or higher; and the hydrogen content of said remaining mixture is determined so that the dew point at the pressure of the column, of the fraction of this remaining mixture constituted of said lighter components be higher than the temperature TF but close to the latter.

According to a first embodiment, the partial removal of hydrogen is carried out by permeation.

According to a variant which is particularly adapted to the cases where it is intended to simultaneously produce pure hydrogen, this partial removal of pure hydrogen is carried out by PSA (Pressure Swing Adsorption), said remaining mixture being constituted by the residual gas from this adsorption and being compressed before being introduced in the column, the composition of said remaining mixture being eventually adjusted by permeation.

It is also an object of the invention to provide an apparatus adapted for carrying out such process. This apparatus is characterized in that it comprises:

means for removing a portion of the hydrogen from the mixture, to give a remaining mixture; and a distillation column which is fed with this remaining mixture and includes a head condenser which ensures a reflux in the column, this condenser being cooled by means of a cooling device capable of supplying a cold temperature TF of the order of −40° C. or higher;

the means for the partial removal of hydrogen being adapted so that the fraction of said remaining mixture consisting of said lighter components has, at the pressure of the column, a dew point higher than the temperature TF but close to the latter.

BRIEF DESCRIPTION OF DRAWINGS

Examples for carrying out the invention will now be described with reference to the annexed drawings, in which.

DESCRIPTION OF PREFERRED EMBODIMENTS

Figure 1:
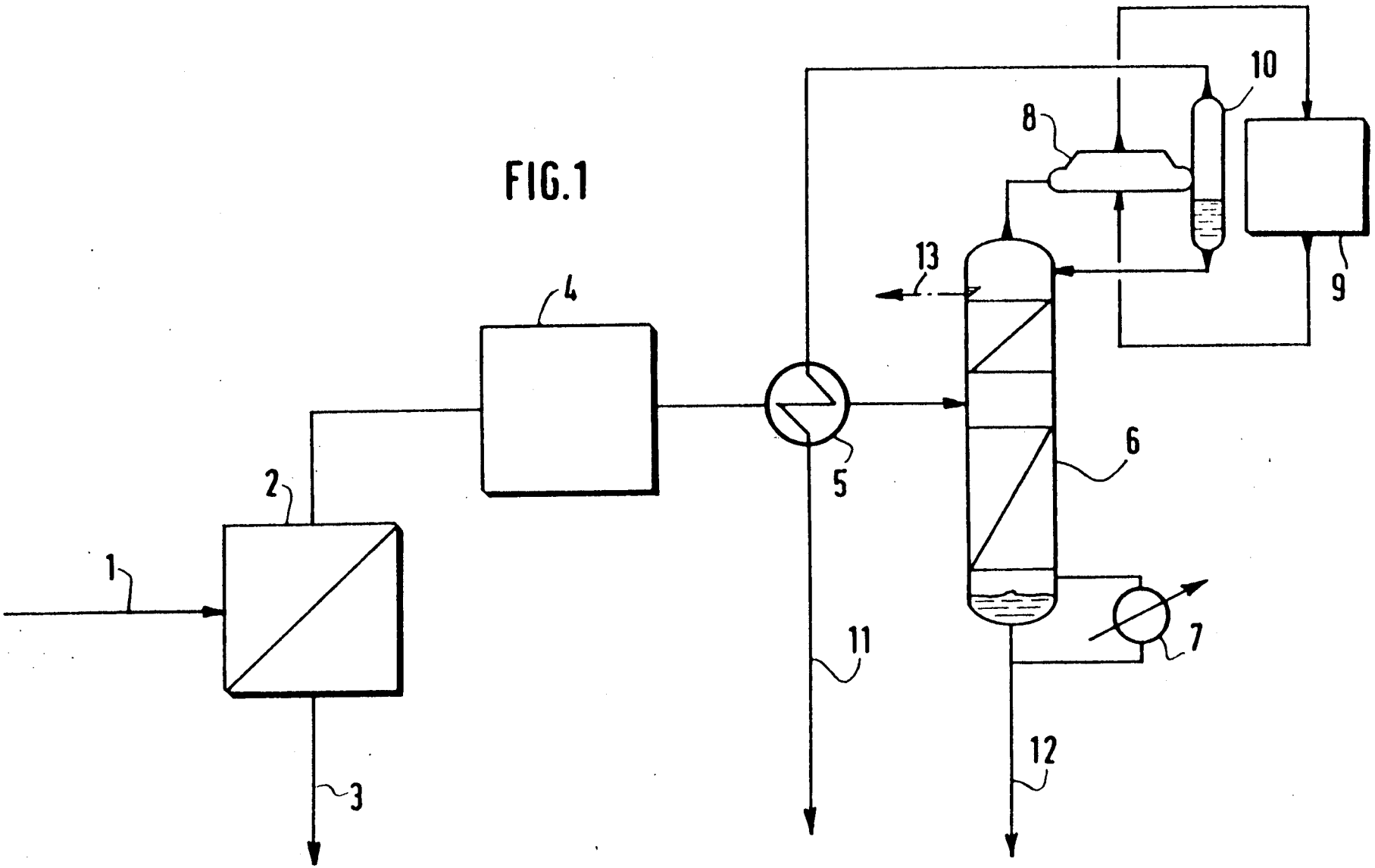
FIGS. 1 and 2 are schematic representations of two apparatuses according to the invention.

In the examples which are represented, the residual gas of petroleum refinery having the following typical composition is treated: 74% $H_2$, 12.2% $C_1$, 9.5% $C_2$, 2.7% $C_3$, 1.6% $C_4$+, as well as traces of benzene compounds and water, so as to recover GPL ($C_3$+) therefrom.

The gas to be treated is introduced under 31 bars, via a duct 1, in the high pressure space of a permeator 2. The permeated product, forming about two thirds of the initial flow and constituted of hydrogen at a purity of 98 to 99%, is removed from the low pressure permeator under a few bars through a duct 3. The residue from the permeation, containing most of the hydrocarbons, has the following composition: 21.3% $H_2$, 36.7% $C_1$, 28.9% $C_2$, 8.2% $C_3$, 4.9% $C_4$+, as well as traces of benzene compounds and water. This residue is dried in a drying apparatus 4, then is cooled in an indirect heat exchanger 5, after which it is introduced under about 30 bars at an intermediate level of a distillation column 6.

In the bottom portion, the column 6 is provided with a reboiler 7 which operates at about 100° C., and at the top thereof, with a condenser 8 which operates at about −40° C. and is refrigerated by means of a single stage refrigerating device 9 formed of a refrigerating unit, which operates for example with "Freon". The vapor which is present in the top part of the column is partially condensed by means of the condenser 8 after which it is separated into a single vapor phase and a single liquid phase in a phase separator 10. The vapor phase contains nearly all the hydrogen, methane and ethane which are present in the residue obtained by permeation, and is removed through a duct 11 as residual gas of the apparatus after being cooled in the heat exchanger 5. The liquid phase is sent back as a reflux in the top part of the column 6. The GPL are removed at the bottom portion of the column through a duct 12.

The residue obtained by permeation contains a quantity of $C_1$ and $C_2$ light hydrocarbons which is function of the composition of the starting gas. The hydrogen content is determined by providing a suitable size for the permeator 2, so that the dew point of these light hydrocarbons and hydrogen (i.e. in practice the residual gas) at the pressure of the column 6, be slightly higher than the coldest temperature that can be reached in condenser 8 with a single stage refrigerating unit 9, which means about −40° C.

Thus, the upper portion of column 6 is responsible for a nearly complete removal of hydrogen by washing, so that the only loss of GPL is that which takes place in permeator 2. By selecting a dew point for the residual gas which is very close to −40° C., the amount of hydrogen removed by permeation, and consequently the loss of GPL is kept to a minimum which is compatible with the refrigerating unit 9. In practice, it will be observed that this loss can be made negligible, so that the yield of extraction of GPL is close to 100%.

On the other hand, because the absence of any cryogenic heat exchange line, the benzene compounds in the starting gas present no disadvantage and will simply be found in the GPL obtained. Similarly, if the water content of the starting gas is sufficiently low, one may eventually dispense with the drying device 4.

As a variant, as indicated in mixed line at 13, with the same apparatus, it is possible to additionally produce a $C_1/C_2$ cut by withdrawing liquid from the top part of the column 6. However, the dew point of the vapor in the top part of the column and of the residual gas is then lowered, which requires as a compensation a more important withdrawal of hydrogen by permeation and, consequently, leads to a degradation of the yield of extraction of the GPL.

Figure 2:
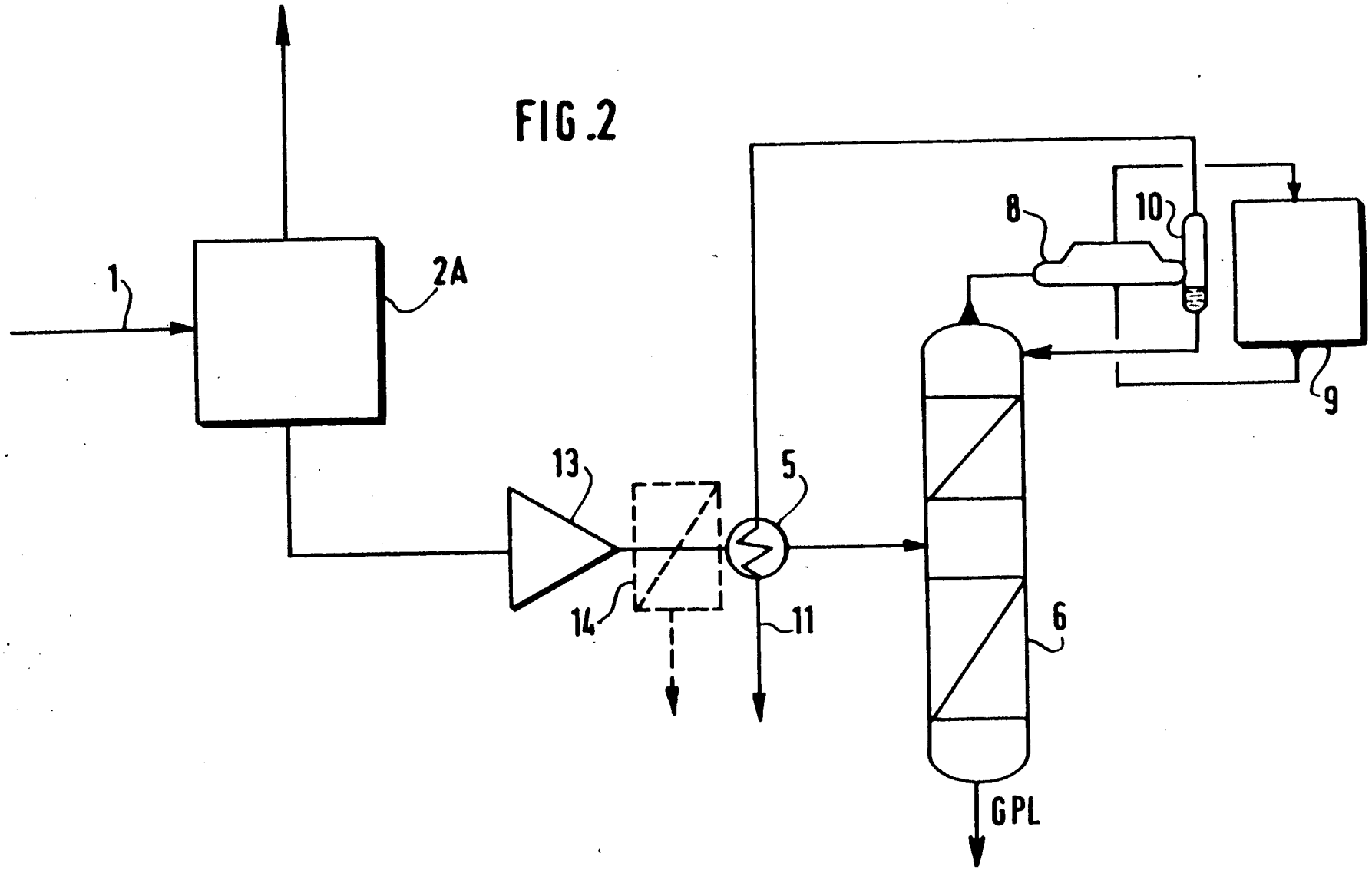

The apparatus of FIG. 2 only differs from that of FIG. 1 by the treatment of the gas upstream of the heat exchanger 4. For example, this apparatus can be used if it is intended to produce very pure hydrogen, for example, one which is intended for electronic applications.

Indeed, the starting gas is first treated by PSA adsorption (Pressure Swing Adsorption) in an adsorption device 2A, which removes from the gas about the same quantity of hydrogen as previously mentioned. The remaining mixture, consisting of the residual gas from the device 2A is available at a low pressure typically close to atmospheric pressure. It is recompressed at about 30 bars by the compressor 13, then cooled in the exchanger 5, then introduced in the column 6 as previously mentioned.

If the hydrogen content of the résidual gas of the device 2A leads to a dew point of the residual gas of the column of about −40° C. or higher, one merely selects a refrigerating unit 9 operating at this dew point. The yield of extraction of the GPL will then be always practically 100%, since no loss of GPL will take place in this device 2A.

On the other hand, if this hydrogen content is too high (which means that the dew point in the upper part of the column would be lower than −40° C.) it will be lowered to a value which will give a dew point which is slightly higher than −40° C., by means of a permeator 14 mounted between the outlet of the compressor 13 and the exchanger 5, as schematically illustrated in broken line in FIG. 2.

It will be understood that the invention can be used in other cases for the recovery of heavier hydrocarbons. For example, with the same starting gas as indicated above, it is possible to recover only the $C_4+$, by selecting the pressure of the column and the hydrogen content of the mixture introduced in this column so that the dew point of the mixture $H_2$, $C_1$, $C_2$ and $C_3$ which constitutes the residual gas of the column be higher than −40° C.; a cooling device 9 which is adapted to this temperature will be selected, and this device can eventually formed of a simple water circulation at ambient temperature.

I claim:

1. Process for the recovery of the heaviest hydrocarbons from a gaseous mixture additionally containing lighter components including hydrogen, such as for the recovery of GPL ($C_3+$) from a residual gas of petroleum refinery, which comprises:

removing a portion of the hydrogen from the mixture;

introducing the remaining mixture into a distillation column at an intermediate level thereof, said distillation column (6) including a head condenser (8) which provides reflux in the column, and cooling said condenser by means of a cooling device (9) to provide a cold temperature TF of the order of −40° C. or higher; and wherein the hydrogen content of the remaining mixture introduced into the distillation column is predetermined so that the dew point at the pressure of the column, of the fraction of said remaining mixture constituted by said lighter components, is higher than the temperature TF but in the vicinity thereof.

2. Process according to claim 1 wherein said partial removal of hydrogen is carried out by permeation (at 2), said remaining mixture being constituted by the residue derived from this permeation.

3. Process according to claim 2, which comprises drying said residue (at 4) before introducing same in the column (6).

4. Process according to claim 1, wherein said partial removal of hydrogen is carried out by PSA adsorption (at 2A), said remaining mixture being constituted by the residual gas from said adsorption and being compressed (at 13) before being introduced into the column (6), the composition of said remaining mixture being eventually adjusted by permeation (at 14).

5. Process according to claim 1, wherein said remaining mixture is cooled (at 5) by indirect heat exchange with a residual gas produced in the top part of the column (6).

6. Apparatus for the recovery of the heaviest hydrocarbons from a gaseous mixture additionally containing lighter components including hydrogen, such as for the recovery of GPL ($C_3+$) of a residual gas from petroleum refinery, which comprises:

means (2, 2A, 14) for removing a portion of the hydrogen from the mixture, to provide a remaining mixture; and a distillation column (6), means for feeding said remaining mixture to said distillation column, said distillation column including a head condenser (8) which produces a reflux in said column, a cooling device (9) adapted to provide a cold temperature TF of the order of −40° C. or higher to cool said condenser;

means for the partial withdrawal of hydrogen such that the fraction of said remaining mixture constituted by said lighter components at the pressure of the column, has a dew point higher than a temperature TF but close to the latter.

7. Apparatus according to claim 6, wherein said means for the partial withdrawal of hydrogen comprise a permeator (2).

8. Apparatus according to claim 7, wherein a drying means (4) is mounted at the high pressure outlet of the permeator (2).

9. Apparatus according to claim 6, wherein said means for the partial removal of hydrogen comprise a PSA adsorber (2A), a compresser (13), eventually followed by permeator (14), disposed between the outlet of the residual gas from this adsorber and the column (6).

10. Apparatus according to claim 6, which comprises an indirect heat exchanger (5) which is on the one hand fed by said remaining mixture, and on the other hand by a residual gas produced at the top part of the column (6).

* * * * *